US007618205B2

(12) United States Patent
Hamaba et al.

(10) Patent No.: US 7,618,205 B2
(45) Date of Patent: Nov. 17, 2009

(54) WEB CONVEYANCE MECHANISM AND IMAGE FORMING APPARATUS

(75) Inventors: Keijirou Hamaba, Kanagawa (JP); Yoshihisa Takanozawa, Kanagawa (JP); Yukihide Toda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 630 days.

(21) Appl. No.: 11/399,494

(22) Filed: Apr. 7, 2006

(65) Prior Publication Data

US 2007/0065216 A1 Mar. 22, 2007

(30) Foreign Application Priority Data

Sep. 20, 2005 (JP) ..... 2005-272912

(51) Int. Cl.
*B41J 13/26* (2006.01)
*B41J 15/00* (2006.01)

(52) U.S. Cl. ..... 400/630; 400/579; 400/619; 226/17; 226/23

(58) Field of Classification Search ..... 400/579, 400/619, 630; 399/395; 226/15, 16, 17, 226/21, 23

See application file for complete search history.

(56) References Cited

U.S. PATENT DOCUMENTS 3,107,036 A * 10/1963 Alexeff et al. ..... 242/615.1
3,176,980 A * 4/1965 Mitchell et al. ..... 271/251
3,533,542 A * 10/1970 Eishiro et al. ..... 226/22
5,083,879 A * 1/1992 Sato et al. ..... 400/579
5,138,341 A * 8/1992 Kobayashi ..... 346/136
5,179,390 A * 1/1993 Yokoyama et al. ..... 347/215
5,947,617 A * 9/1999 Kondo ..... 400/579
6,068,418 A * 5/2000 Fox ..... 400/579
6,851,878 B2 * 2/2005 Hemmerlin ..... 400/636
6,951,429 B2 * 10/2005 Aoyama ..... 400/630
7,178,914 B2 * 2/2007 Marra et al. ..... 347/104

FOREIGN PATENT DOCUMENTS

JP A 7-89645 4/1995
JP A 10-35965 2/1998
JP A 11-59978 3/1999

* cited by examiner

*Primary Examiner*—Ren Yan
(74) *Attorney, Agent, or Firm*—Oliff & Berridge, PLC

(57) ABSTRACT

A web conveyance mechanism for conveying a band-type web includes: a side guide provided on one end side of the web in its width direction that guides one end of the web in the width direction which abuts on the side guide and that serves as a positional reference in the width direction for the web; an abutting unit that pushes the web to the side guide and adjusts an abutting force with which the web pushes the side guide; a measuring unit that measures the abutting force with which the web abutting on the side guide pushes the side guide; and a controller that adjusts the abutting unit so as to obtain a desired abutting force based on a result of detection by the measuring unit.

10 Claims, 5 Drawing Sheets

WEB CONVEYANCE MECHANISM AND IMAGE FORMING APPARATUS

CROSS-REFERENCE TO RELATED APPLICATION

This application claims priority under 35 USC 119 from Japanese Patent Application No. 2005-272912, the disclosure of which is incorporated by reference herein.

BACKGROUND

1. Technical Field

The present invention relates to a web conveyance mechanism and an image forming apparatus.

2. Related Art

In a tandem type image forming apparatus using continuous paper, a side guide on which the end of continuous paper is abutted is provided as a paper guide, thereby skewing of the continuous paper is corrected.

In the image forming apparatus having such paper guide, a line sensor measures the position of the end of the continuous paper, and skew correction is performed on the continuous paper based on the result of measurement.

SUMMARY

According to an aspect of the present invention, there is provided a web conveyance mechanism for conveying a band-type web, including: a side guide provided on one end side of the web in its width direction that guides one end of the web in the width direction which abuts on the side guide and that serves as a positional reference in the width direction for the web; an abutting unit that pushes the web to the side guide and adjusts an abutting force with which the web pushes the side guide; a measuring unit that measures the abutting force with which the web abutting on the side guide pushes the side guide; and a controller that adjusts the abutting unit so as to obtain a desired abutting force based on a result of detection by the measuring unit.

BRIEF DESCRIPTION OF THE DRAWINGS

The above and other object, features and advantages of the present invention will become more apparent from the following detailed description when taken in conjunction with the accompanying drawings wherein.

DETAILED DESCRIPTION

Hereinbelow, an image forming apparatus according to an embodiment of the present invention will now be described in detail in accordance with the accompanying drawings.

Figure 1:
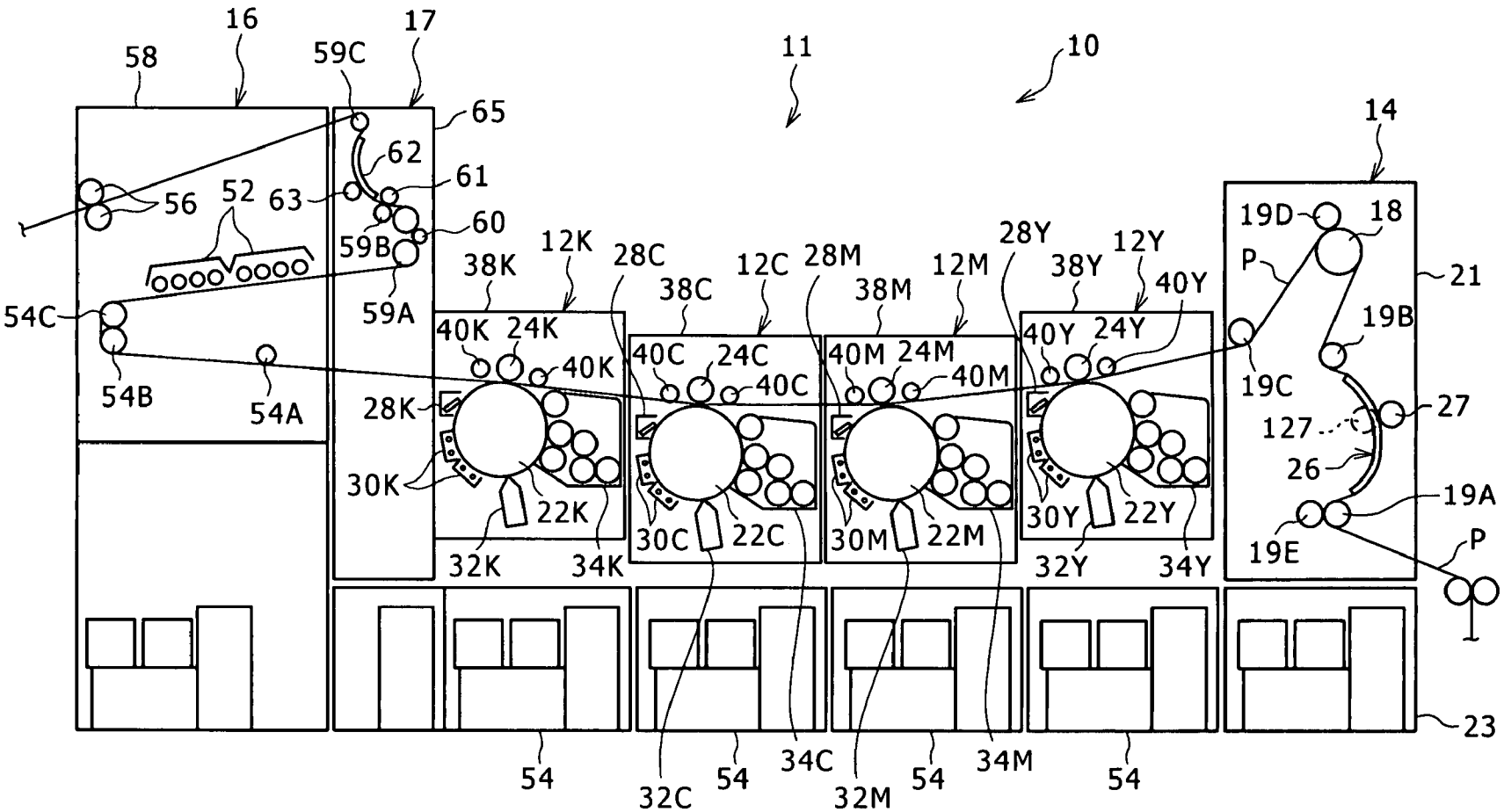
FIG. 1 is an explanatory view schematically showing the structure of a color laser printer according to an embodiment of the present invention.
Figure 2:
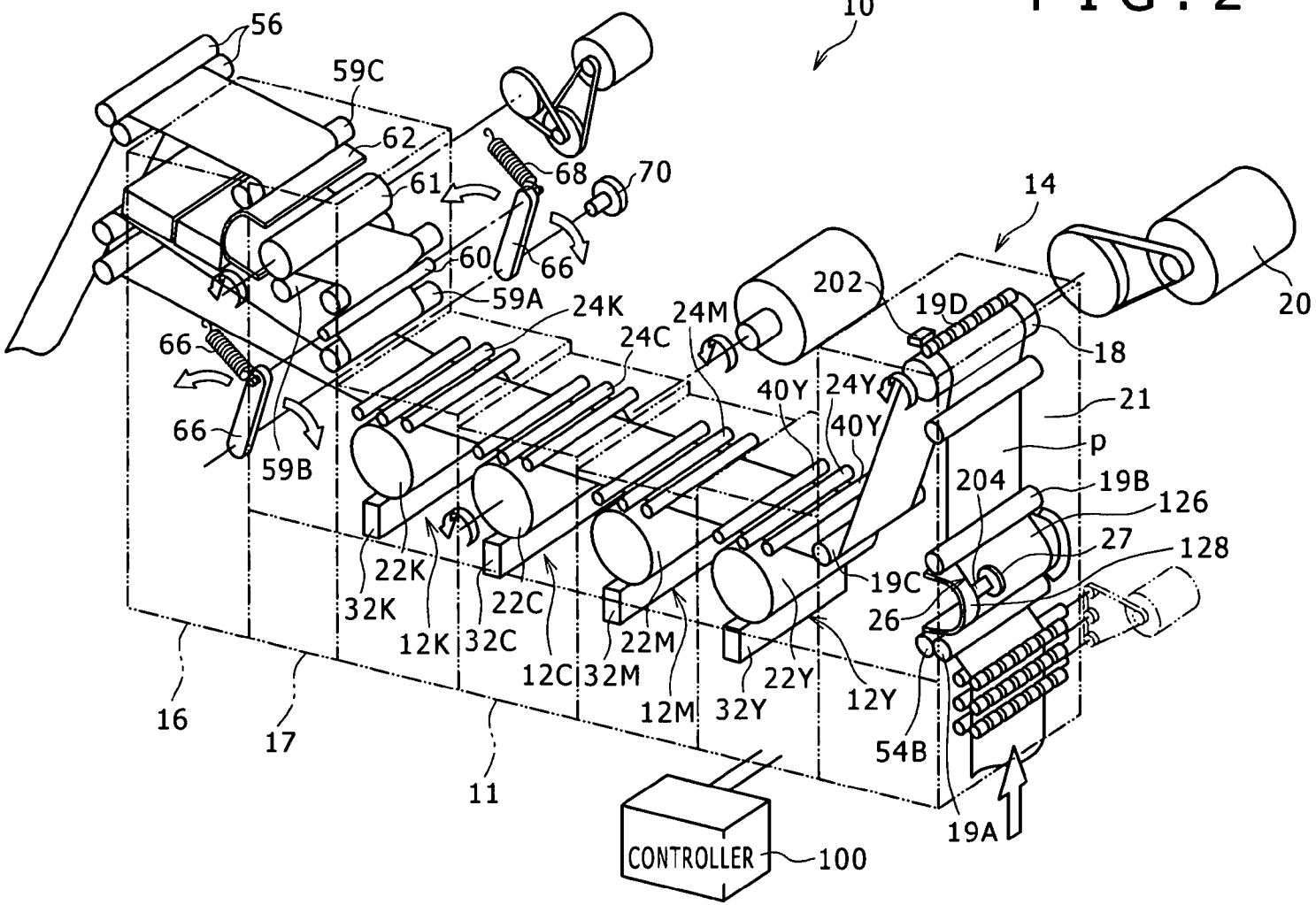
FIG. 2 is a perspective view schematically showing the structure of the color laser printer according to the embodiment of the present invention.

As shown in FIGS. 1 and 2, a color laser printer (hereinbelow, referred to as a "printer") 10 as an image forming apparatus has an image forming part 11 to perform image formation on continuous paper P. In the image forming part 11, print parts 12Y, 12M, 12C and 12K to sequentially transfer respective yellow (Y), magenta (M), cyan (C), and black (K) toner images onto the continuous paper P are arranged from the upstream side in a conveyance direction of the continuous paper P.

Note that when it is necessary to discriminate Y, M, C and K colors, any one of Y, M, C and K is attached to a reference numeral and that when it is not necessary to discriminate Y, M, C and K colors, such Y, M, C and K are omitted. Further, the print parts 12Y, 12M, 12C and 12K will also be described as print parts 12Y to 12K.

A fixing part 16 to fix the unfixed toner images transferred by the print parts 12Y, 12M, 12C and 12K and a paper discharge part 17 to discharge the continuous paper P passed through the fixing part 16 are provided on the downstream side of the print parts 12Y to 12K in the conveyance direction.

A paper conveyance part 14 to feed the continuous paper P to the image forming part 11 is provided on the upstream side of the image forming part 11 in the conveyance direction.

The paper conveyance part 14 has a main drive roller 18 around which the continuous paper P is wound. Idle rollers 19A and 19B around which the continuous paper P is wound are provided on the upstream side of the main drive roller 18 of the paper conveyance part 14 in the conveyance direction, and an idle roller 19C around which the continuous paper P is wound is provided on the downstream side of the main drive roller 18 in the conveyance direction. Further, an idle roller 19D is in press-contact with the drive roller 18, and the continuous paper P is held and conveyed with the idle roller 19D and the main drive roller 18. Note that the idle roller 19D has plural rollers arrayed at intervals in its axial direction (see FIG. 6B). Further, the main drive roller 18 is driven with a paper conveyance motor 20 (see FIG. 2). A controller 100 (see FIG. 2) which controls the overall printer 10 controls the amount of feeding of the continuous paper P based on the pulse number of the paper conveyance motor 20.

An idle roller 19E is in press-contact with the idle roller 19A, and the continuous paper P is held and conveyed with the idle roller 19A and the idle roller 19E. Note that the idle roller 19E also has plural rollers arrayed at intervals in its axial direction (see FIG. 6B). Further, the idle roller 19A and the idle roller 19E apply resistance to conveyance of the continuous paper P, such that a tension is applied to the continuous paper P between the above-described idle roller 19D and the main drive roller 18. In other words, this arrangement forms a back tension mechanism where a force is applied in an opposite direction to the conveyance direction of the continuous paper P. Further, the nip pressure balance between the idle roller 19A and the idle roller 19E is adjustable by a nip pressure adjustment mechanism 110 shown in FIG. 3.

The nip pressure adjustment mechanism 110 has an eccentric cam 104 to push bearings 102 at both ends of the idle roller 19E. The eccentric cam 104 is rotated with an adjustment motor 106, thereby a pressing force to push the idle roller 19E against the idle roller 19A can be adjusted. The pressure balance in the width direction can be adjusted by changing the pressing forces at both right and left ends. Note that in the figure, only one end is shown, but the other end has the same structure. Further, the adjustment motor 106 is controlled by the controller 100.

Then angle adjustment (skew correction) of the continuous paper P in the conveyance direction can be performed by adjusting the nip pressure balance in the width direction. For example, when the nip pressure on one end side in the width direction is raised and the nip pressure on the other side is lowered, the continuous paper P is sent aslant. Note that when the nip pressure is adjusted, the angle of the continuous paper P in the conveyance direction is changed and at the same time the paper is moved in the width direction.

Accordingly, the nip pressure balance in the width direction between the idle roller 19A and the idle roller 19E is adjusted, thereby an abutting force to abut on a side guide 128 (details will be described later) can be adjusted.

Further, a conveyance guide 26 is provided between the idle roller 19A and the idle roller 19B. The conveyance guide 26 is provided with a pair of alignment rollers 27 and 127 to hold the continuous paper P. Further, a U-shaped curved plate 126 around which the continuous paper P is wound and the side guide 128 to guide one end of the continuous paper P in the width direction (direction orthogonal to the conveyance direction) are formed in the conveyance guide 26. Note that a hole is formed in the curved plate 126 such that the alignment roller 127 abuts on the continuous paper P.

Further, the width of the alignment rollers 27 and 127 is far narrower than that of the idle rollers 19A, 19B, 19C and 19D. Further, the continuous paper P is moved to one end side in the width direction with a slanted roller, with its rotation axis always slanted at an angle to the conveyance direction of the continuous paper P.

Accordingly, the above-described idle rollers 19A and 19E and the alignment rollers 27 and 127 push one end of the continuous paper P in the width direction against the side guide 128 of the conveyance guide 26 such that the paper is conveyed along the side guide 128.

Note that the side guide 128 is a positional reference for the end of the continuous paper P. In this manner, the one end of the continuous paper P is conveyed along the side guide 128, thereby the position in the width direction is determined. Further, as the continuous paper P in bent state (with elasticity) by the curved plate 126 is abutted on the side guide 128, the paper is easily conveyed along the side guide 128 without buckling.

Further, the alignment roller 127 is a drive roller and the alignment roller 27 is a driven roller to be rotated in accordance with the rotation of the alignment roller 127.

Figure 4:
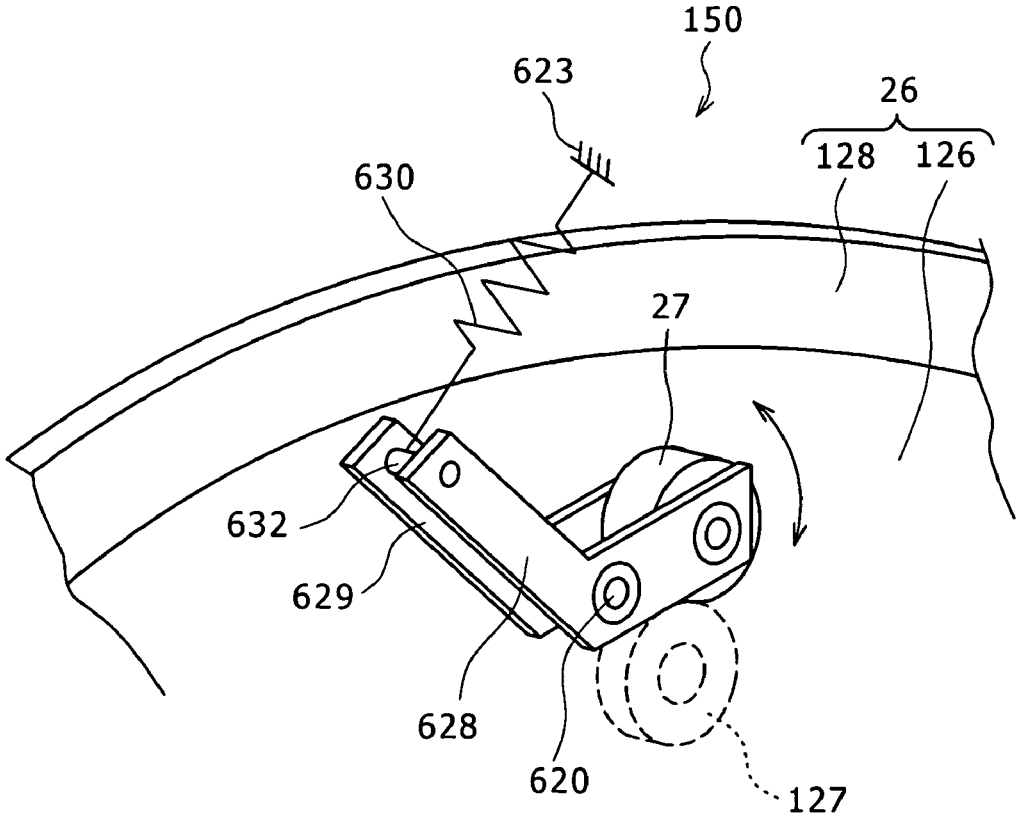
FIG. 4 is a perspective view schematically showing an angle adjustment mechanism.
Figure 5:
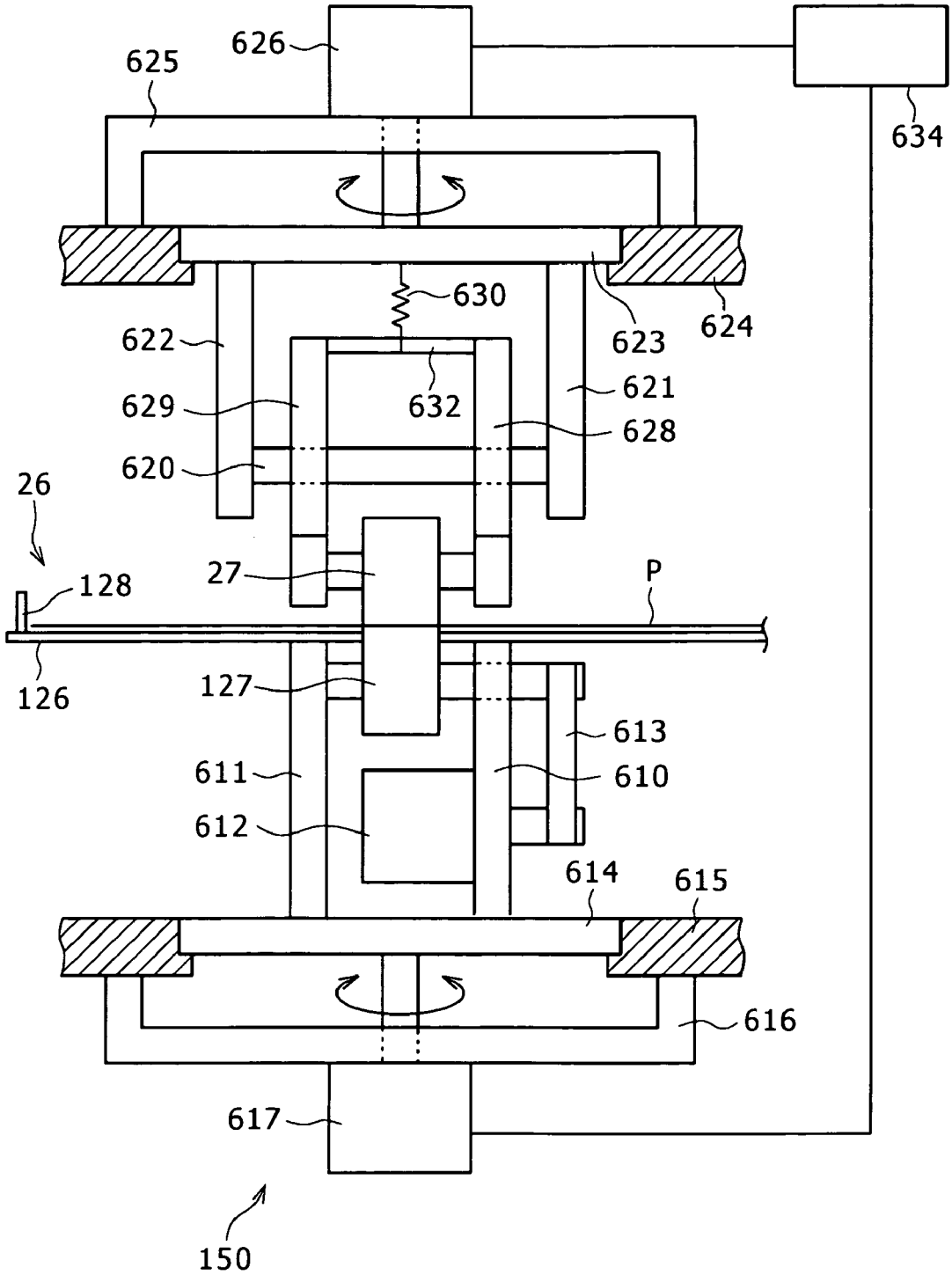
FIG. 5 is a front view showing the construction of the angle adjustment mechanism.

Further, the angles of the alignment rollers 27 and 127 are varied by an angle adjustment mechanism 150 shown in FIGS. 4 and 5.

As shown in FIG. 5, the alignment roller 127 side of the angle adjustment mechanism 150 has support arms 610 and 611 to rotatably support the alignment roller 127. Further, the alignment roller 127 is rotate-driven with a belt 613 to transmit the rotation of a drive motor 612. The support arms 610 and 611 are fixed to a disc 614. The disc 614 is rotatably supported with a support member 615. The disc 614 is rotated by an angle adjustment motor 617 fixed to a fixing member 616 attached to the support member 615, thereby the angle of the alignment roller 127 is adjusted.

On the other hand, as shown in FIGS. 4 and 5, the alignment roller 27 side has support arms 628 and 629 to rotatably support the alignment roller 27. The support arms 628 and 629 are supported with support arms 621 and 622 to rotatably support a support shaft 620. The support arms 621 and 622 are fixed to a disc 623. The disc 623 is rotatably supported with a support member 624. The disc 623 is rotated by an angle adjustment motor 626 fixed to a fixing member 625 attached to the support member 624, thereby the angle of the alignment roller 27 is adjusted.

Further, an extension coil spring 630 is attached between an end shaft 632 opposite to the alignment roller 27 with the support shaft 620 therebetween, and the disc 623. The support arms 628 and 629 are rotated about the support shaft 620 with a tensile force of the extension coil spring 630, and the alignment roller 27 is pressed against the alignment roller 127.

Note that a motor controller 634 to control the angle adjustment motors 617 and 626 adjusts the angles of the alignment rollers 27 and 127 in a synchronizing manner such that the angles of the alignment rollers 27 and 127 become the same. Further, the motor controller 634 is controlled by the controller 100 to control the overall apparatus.

In this manner, the abutting force to move the continuous paper P in the width direction to be abutted on the side guide 128 can be adjusted by adjustment of the angles of the alignment rollers 27 and 127.

As shown in FIG. 6, a measuring device 300 to measure the abutting force with which one end of the continuous paper P abuts on and pushes the side guide 128 is attached to the side guide 128.

Note that as the side guide 128 is the positional reference in the width direction, the measuring device 300 performs measurement without moving the side guide 128 in the width direction. For example, the side guide 128 is supported with the measuring device 300, and the measuring device 300 is fixed to a case or the like. The abutting force applied to the side guide 128 is measured by a load sensor or the like of the measuring device 300.

Then the controller 100 adjusts the angles of the alignment rollers 27 and 127 and the nip pressure balance in the width direction between the idle roller 19A and the idle roller 19E based on the result of measurement by the measuring device 300 such that the abutting force is within a desired range. Note that the desired abutting force may be set by the user's input or the like in correspondence with the type of continuous paper (elasticity) or the like.

The print parts 12Y to 12K respectively have a photo conductor 22, and a transfer roller 24, a cleaning device 28, a charger 30, an LED head 32, and a developing device 34 are arranged around the photo conductor 22 sequentially in a rotational direction of the photo conductor 22 (in an arrow direction in the figure). Note that in FIG. 2, the cleaning device 28, the charger 30 and the developing device 34 are omitted for the sake of convenience.

Further, the print parts 12Y to 12K respectively having the photo conductor 22, the cleaning device 28, the charger 30 and the LED head 32, have print frames 38Y to 38K to support them. The adjacent print frames 38Y to 38K are coupled by connecting bases 54 to elevatably support the print frames 38Y to 38K with bolts and nuts (neither shown) and positioning the print frames 38Y to 38K via coupling plates (not shown) and screw-fixing them. Further, the base 54 to support the print frame 38Y is connected to a base 23 to support a paper conveyance frame 21.

The respective transfer rollers 24 are supported with the print frames 38Y to 38K. The transfer roller 24 abuts on an upper surface of the photo conductor 22, and, with the photo conductor 22, holds and conveys the continuous paper P, to transfer a toner image formed by the developing device 34 on the photo conductor 22 onto the continuous paper P. Further, two guide rollers 40 are rotatably supported on the upstream side and downstream side of the transfer roller 24.

Further, the charger 30 charges the surface of the photo conductor 22, and the LED head 32 forms a latent image by line-exposure on the surface of the photo conductor 22. Then the developing device 34 forms a toner image by attaching toner to the latent image formed on the photo conductor 22.

Further, the cleaning device 28 sweeps toner which has not been transferred onto the continuous paper P and is remaining on the surface of the photo conductor 22.

On the other hand, the fixing part 16 has a flash fixing device 52, idle rollers 54A, 54B and 54C, and a paper discharge roller 56. The idle rollers 54A, 54B and 54C, then the flash fixing device 52, and the paper discharge roller 56 are arranged in this order along the conveyance direction, and both ends of these elements in a direction orthogonal to the conveyance direction are supported with a fixing frame 58.

The idle rollers 54A, 54B and 54C are provided on the rear surface side of the printing surface of the continuous paper P, and the idle roller 54C is provided above the idle roller 54B. In this arrangement, the continuous paper P wound around the idle rollers 54A, 54B and 54C is reversed and conveyed with its printing surface faced up.

The flash fixing device 52, which is provided on the printing surface side of the continuous paper P conveyed with its printing surface faced up, irradiates the printing surface of the continuous paper P with infrared rays. By this irradiation, unfixed toner on the continuous paper P is heated and melted, then coagulated and fixed to the continuous paper P.

The paper discharge roller 56 discharges a toner-fixed area of the continuous paper P from the printer 10. The continuous paper P passed through the flash fixing device 52 is temporarily discharged from the fixing part 16, passed through the paper discharge part 17, then returned to the fixing part 16, and discharged by the paper discharge roller 56.

In the paper discharge part 17, an idle roller 59A, a tensile force applying roller 60, a sub drive roller 61, an idle roller 59B, a conveyance guide 62, an alignment roller 63, and an idle roller 59C are arranged sequentially in the conveyance direction. The both ends of these elements in the direction orthogonal to the conveyance direction are directly supported or supported via support member or the like, with a paper discharge frame 65. The paper discharge frame 65 is connected to the print frame 38K and the fixing frame 58.

The sub drive roller 61 is provided above the idle roller 59A. The continuous paper P wound around the idle roller 59A and the sub drive roller 61 is turned around and conveyed upward. Further, the idle roller 59B, which is in press-contact with the sub drive roller 61, is rotated in accordance with the rotation of the sub drive roller 61, and, with the sub drive roller 61, holds and conveys the continuous paper P.

Further, the tensile applying roller 60 is provided between the idle roller 59A and the sub drive roller 61. The continuous paper P is windle-conveyed between the idle roller 59A and the tensile applying roller 60 and between the tensile applying roller 60 and the sub driver roller 61. The tensile applying roller 60 is swingably supported at both ends in its axis direction with an arm 66 (see FIG. 2).

The arm 66 is biased to the continuous paper P side with a biasing member such as a spring 68, and the tensile applying roller 60 is biased to the continuous paper P side, thus the tensile is applied to the continuous paper P. Further, the position of the arm 66 is detected by a sensor 70, and the number of rotations of the sub drive roller 61 is controlled such that the position of the arm 66 is always in a fixed position.

The conveyance guide 62 and the alignment roller 63 (see FIG. 1) are provided on the downstream side of the sub drive roller 61 in the conveyance direction.

The idle roller 59C is provided on the downstream side of the conveyance guide 62 in the conveyance direction. The continuous paper P is wound around the idle roller 59C, and is turned around toward the paper discharge roller 56 of the fixing part 16, and guided to the paper discharge roller 56.

Next, a print operation of the printer 10 will be described.

Figure 3:
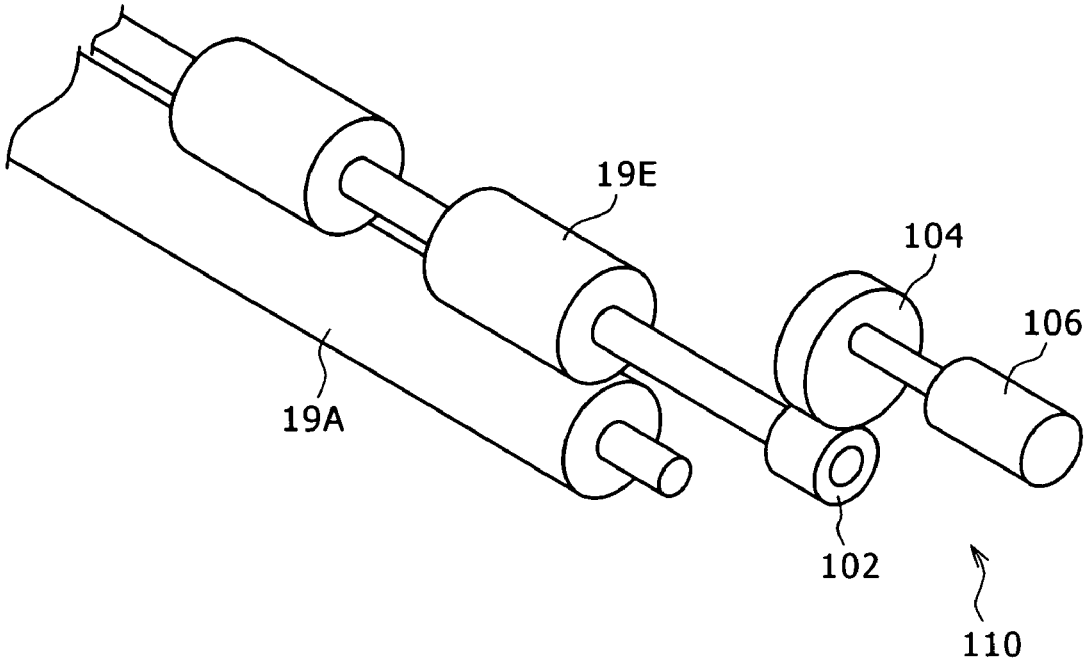
FIG. 3 is a perspective view schematically showing a nip pressure adjustment mechanism.

As shown in FIGS. 2 and 3, the controller 100 first drives the paper conveyance motor 20 to convey an image formation start position of the continuous paper P to a toner transfer position of the print part 12Y. Then the controller 100 rotates the paper conveyance motor 20 to convey the continuous paper P. Further, the controller 100 causes application of transfers bias (positive bias) to the transfer roller 24Y and transfer a yellow toner image on the photo conductor 22Y onto the continuous paper P.

Similarly, the controller 100 causes overlay-transfer of respective color toner images on the respective photo conductors 22 onto the continuous paper P.

When the head of an area of an unfixed full-color toner image where the yellow, magenta, cyan and black color toner images are overlaid has been conveyed to the entrance of an infrared ray irradiation area of the flash fixing device 52, the controller 100 causes emission of infrared rays by a flash lamp.

Then, the unfixed full-color toner image on the continuous paper P is heated and melted with the infrared rays emitted from the flash lamp when the paper is passed through the infrared ray irradiation area of the flash fixing device 52, and coagulated when the paper has been passed through the infrared ray irradiation area and fixed to the continuous paper P. Then, the continuous paper P where the full-color image is fixed is guided to the paper discharge roller 56.

Next, the operation of the present embodiment will be described.

Figure 6A:
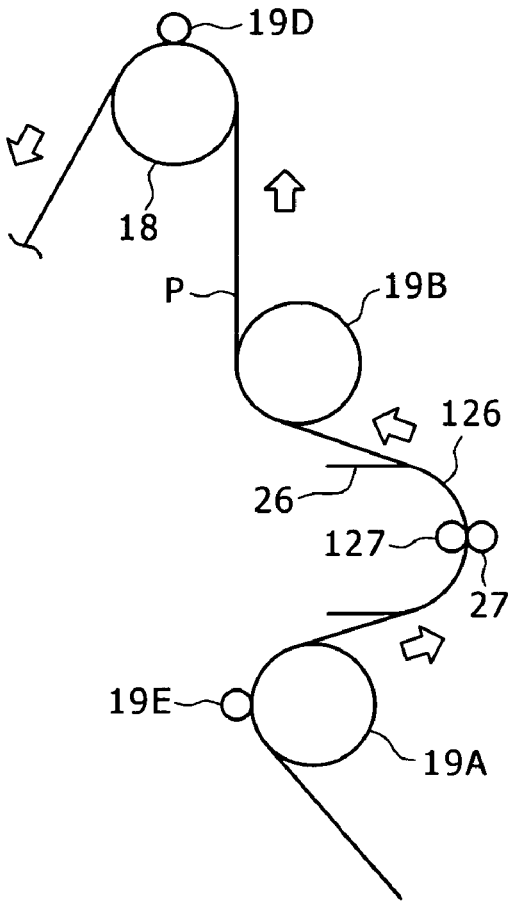
FIGS. 6A and 6B are a side view and a front view showing principal elements of the color laser printer according to the embodiment of the present invention.
Figure 6B:
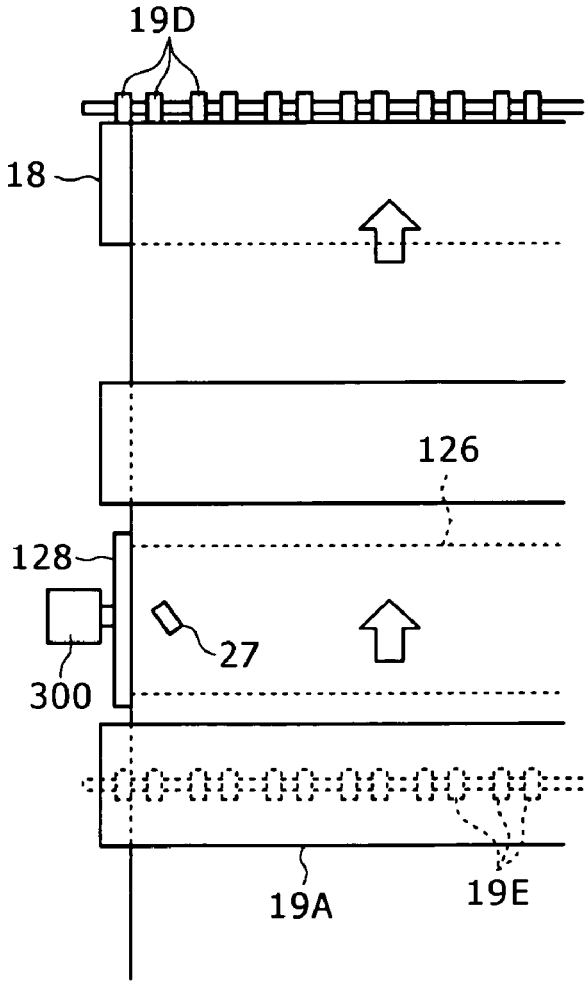

As shown in FIGS. 6A and 6B, the measuring device 300 measures the abutting force with which one end of the continuous paper P abutting on the side guide 128 pushes the side guide 128. The controller 100 adjusts the angles of the alignment rollers 27 and 127 and the nip pressure balance in the width direction between the idle roller 19A and the idle roller 19E based on the result of measurement by the measuring device 300 so as to adjust the abutting force to be an abutting force within a desired range.

Accordingly, this prevents a problem that the continuous paper P is not conveyed along the side guide 128 because the abutting force is too weak or the continuous paper P is buckled because the abutting force is too strong. Further, even if the continuous paper P has irregularity at its end, the conveyance is not influenced by the irregularity. Further, even when the abutting force is changed due to uneven setting of the continuous paper P or the like, as adjustment is performed so as to obtain a predetermined abutting force, no problem occurs.

That is, skewing of conveyed continuous paper can be reliably corrected. Further, the above arrangement prevents a problem that one end of the continuous paper P is damaged because the abutting force is too strong.

The desired abutting force may be set by the user's input or the like in correspondence with the type (elasticity) of the continuous paper.

Note that in the present embodiment, the abutting force with which the continuous paper P abuts on the side guide is adjusted by adjusting the angles of the alignment rollers 27 and 127 and the nip pressure balance in the width direction between the idle roller 19A and the idle roller 19E, although the abutting force may be adjusted by adjusting only one of the angles of the alignment rollers and the nip pressure balance.

Note that the present invention is not limited to the above-described embodiment.

For example, in the above-described embodiment, a full-color laser printer using Y, M, C and K colors has been described. However, the number of colors is not limited to four. The present invention is applicable to a full-color laser printer using five or more colors including light magenta or the like. Otherwise, the present invention is applicable to a laser printer using three or less colors.

Further, for example, in the above-described embodiment, image formation is performed by electrophotography. However, another image forming method may be employed. For example, a so-called ink-jet printing method of forming an image by discharging ink from nozzles may be employed.

Further, the present invention is applicable to other apparatus than the image forming apparatus. For example, the present invention is applicable to band-type web conveyance in a production line of paper, film or the like.

As described above, according to an aspect of the present invention, there is provided a web conveyance mechanism for conveying a band-type web, including: a side guide provided on one end side of the web in its width direction that guides one end of the web in the width direction which abuts on the side guide and that serves as a positional reference in the width direction for the web; an abutting unit that pushes the web to the side guide and adjusts an abutting force with which the web pushes the side guide; a measuring unit that measures the abutting force with which the web abutting on the side guide pushes the side guide; and a controller that adjusts the abutting unit so as to obtain a desired abutting force based on a result of detection by the measuring unit.

In the above web conveyance mechanism having the above construction, the measuring unit measures the abutting force with which the web pushes the side guide, and the abutting force of the abutting unit is adjusted to be a desired abutting force.

Accordingly, this prevents a problem that the continuous paper is not conveyed along the side guide because the abutting force is too weak or the web is buckled because the abutting force is too strong. Further, even if the web has irregularity at its end, the conveyance is not influenced by the irregularity. Further, even when the web is unevenly set and the abutting force is changed, as adjust is performed so as to obtain a predetermined abutting force, no problem occurs. That is, skewing of the continuous paper can be reliably corrected.

Further, according to the web conveyance mechanism, the abutting unit may have a pair of variable rollers that nip and convey the web, and that have variable nip pressure balance in the width direction of the web, and the controller may adjust the nip pressure balance in the width direction between the pair of variable rollers.

In the above web conveyance mechanism having the above construction, the abutting force is adjusted to a desired abutting force by adjusting the nip pressure balance in the width direction between the pair of variable rollers.

Further, according to the web conveyance mechanism, the abutting unit may have an alignment roller that abuts on the web, with a variable angle with respect to a conveyance direction of the web, and the controller may adjust the angle of the alignment roller.

In the web conveyance mechanism having the above construction, the abutting force is adjusted to a desired abutting force by adjusting the angle of the alignment roller.

Further, according to the web conveyance mechanism, the abutting unit may have: an alignment roller that abuts on the web, with a variable angle with respect to a conveyance direction of the web; and a pair of variable rollers that nip and convey the web, and that have variable nip pressure balance in the width direction of the web, and the controller may adjust the angle of the alignment roller, and adjust the nip pressure balance in the width direction between the pair of variable rollers.

In the web conveyance mechanism having the above construction, the abutting force is adjusted to a desired abutting force by adjusting the angle of the alignment roller and the nip pressure balance in the width direction between the pair of variable rollers.

Further, according to the web conveyance mechanism having any one of the above constructions, the side guide may be provided at an end of a curved plate around which the web is wound.

In the web conveyance mechanism having the above construction, the side guide is provided in the end of the curved plate around which the web is wound. The web, being curved, with strong elasticity, abuts on the side guide. Accordingly, the web is conveyed while it is more stably guided along the side guide.

Further, according to another aspect of the present invention, there is provided an image forming apparatus including the web conveyance mechanism, wherein the web is continuous paper, and an image is formed on the continuous paper.

In the image forming apparatus having the above construction, as the web conveyance mechanism having any one of the above constructions is provided, an image can be formed on continuous paper without occurrence of positional shift in the width direction.

As described above, according to an aspect of the present invention, skewing of continuous paper can be corrected.

The foregoing description of the embodiments of the present invention has been provided for the purposes of illustration and description. It is not intended to be exhaustive or to limit the present invention to the precise forms disclosed. Obviously, many modifications and variations will be apparent to practitioners skilled in the art. The embodiments were chosen and described in order to best explain the principles of the present invention and its practical applications, thereby enabling others skilled in the art to understand the present invention for various embodiments and with the various modifications as are suited to the particular use contemplated. It is intended that the scope of the present invention be defined by the following claims and their equivalents.

What is claimed is:

1. A web conveyance mechanism for conveying a band-type web, comprising:

a side guide provided on one end side of the web in a width direction that guides one end of the web in the width direction which abuts on the side guide and that serves as a positional reference in the width direction for the web;

an abutting unit that pushes the web to the side guide and adjusts an abutting force with which the web pushes the side guide;

a measuring unit that measures the abutting force with which the web abutting on the side guide pushes the side guide; and a controller that adjusts the abutting unit so as to obtain a desired abutting force based on a result of detection by the measuring unit.

2. The web conveyance mechanism according to claim 1, wherein the abutting unit has a pair of variable rollers that nip and convey the web, and that have variable nip pressure balance in the width direction of the web, and the controller adjusts the nip pressure balance in the width direction between the pair of variable rollers.

3. The web conveyance mechanism according to claim 1, wherein the abutting unit has an alignment roller that abuts on the web, with a variable angle with respect to a conveyance direction of the web, and the controller adjusts the angle of the alignment roller.

4. The web conveyance mechanism according to claim 1, wherein the abutting unit has:

an alignment roller that abuts on the web, with a variable angle with respect to a conveyance direction of the web; and a pair of variable rollers that nip and convey the web, and that have variable nip pressure balance in the width direction of the web, and the controller adjusts the angle of the alignment roller, and adjusts the nip pressure balance in the width direction between the pair of variable rollers.

5. The web conveyance mechanism according to claim 1, wherein the side guide is provided at an end of a curved plate around which the web is wound.

6. An image forming apparatus, comprising:

a side guide provided on one end side of a band-type web in a width direction that guides one end of the web in the width direction which abuts on the side guide and that serves as a positional reference in the width direction for the web;

an abutting unit that pushes the web to the side guide and adjusts an abutting force with which the web pushes the side guide;

a measuring unit that measures the abutting force with which the web abutting on the side guide pushes the side guide; and a controller that adjusts the abutting unit so as to obtain a desired abutting force based on a result of detection by the measuring unit;

wherein the web is continuous paper, and an image is formed on the continuous paper.

7. The web conveyance mechanism according to claim 6, wherein the abutting unit has a pair of variable rollers that nip and convey the web, and that have variable nip pressure balance in the width direction of the web, and the controller adjusts the nip pressure balance in the width direction between the pair of variable rollers.

8. The web conveyance mechanism according to claim 6, wherein the abutting unit has an alignment roller that abuts on the web, with a variable angle with respect to a conveyance direction of the web, and the controller adjusts the angle of the alignment roller.

9. The web conveyance mechanism according to claim 6, wherein the abutting unit has:

an alignment roller that abuts on the web, with a variable angle with respect to a conveyance direction of the web; and a pair of variable rollers that nip and convey the web, and that have variable nip pressure balance in the width direction of the web, and the controller adjusts the angle of the alignment roller, and adjusts the nip pressure balance in the width direction between the pair of variable rollers.

10. The web conveyance mechanism according to claim 6, wherein the side guide is provided at an end of a curved plate around which the web is wound.

* * * * *